US008312868B2

(12) United States Patent
Bierl et al.

(10) Patent No.: US 8,312,868 B2
(45) Date of Patent: Nov. 20, 2012

(54) METHOD, DEVICE, AND SYSTEM FOR OPERATING AN INTERNAL COMBUSTION ENGINE

(75) Inventors: Rudolf Bierl, Regensburg (DE); Stephan Heinrich, Pfeffenhausen (DE); Wolfgang Mai, Kronberg (DE); Paul Rodatz, Landshut (DE); Manfred Weigl, Viehhausen (DE); Andreas Wildgen, Nittendorf (DE)

(73) Assignee: Continental Automotive GmbH, Hannover (DE)

( * ) Notice: Subject to any disclaimer, the term of this patent is extended or adjusted under 35 U.S.C. 154(b) by 561 days.

(21) Appl. No.: 12/557,012

(22) Filed: Sep. 10, 2009

(65) Prior Publication Data

US 2010/0059022 A1 Mar. 11, 2010

(30) Foreign Application Priority Data

Sep. 10, 2008 (DE) ..... 10 2008 046 514

(51) Int. Cl.
*F02M 33/04* (2006.01)

(52) U.S. Cl. ..... 123/518; 123/519; 123/520

(58) Field of Classification Search ..... 123/518–520
See application file for complete search history.

(56) References Cited

U.S. PATENT DOCUMENTS

| | | | | |
|---|---|---|---|---|
| 5,626,122 | A | 5/1997 | Azuma | |
| 5,823,171 | A | 10/1998 | Farmer et al. | |
| 6,237,575 | B1 * | 5/2001 | Lampert et al. | 123/520 |
| 6,568,240 | B1 | 5/2003 | Sato et al. | |
| 6,666,200 | B2 * | 12/2003 | Davis et al. | 123/698 |
| 6,932,068 | B2 * | 8/2005 | Osanai | 123/674 |
| 7,322,344 | B2 * | 1/2008 | Yonezawa | 123/520 |
| 7,383,826 | B2 * | 6/2008 | Kano et al. | 123/518 |
| 7,774,128 | B2 * | 8/2010 | Kim | 701/109 |
| 2003/0196645 | A1 * | 10/2003 | Kojima et al. | 123/520 |
| 2008/0179121 | A1 | 7/2008 | Sauvlet et al. | |
| 2012/0016566 | A1 * | 1/2012 | Cunningham et al. | 701/103 |

FOREIGN PATENT DOCUMENTS

| | | | |
|---|---|---|---|
| DE | 60019002 | T2 | 7/2000 |
| DE | 10 2007 002 188 | A1 | 7/2008 |
| DE | 10 2007 033 144 | A1 | 1/2009 |
| EP | 0477418 | B1 | 4/1992 |
| WO | WO 01/18500 | A1 | 3/2001 |

* cited by examiner

*Primary Examiner* — Erick Solis

(74) *Attorney, Agent, or Firm* — Cozen O'Connor

(57) ABSTRACT

A device and a method for operating an internal combustion engine having at least one cylinder and a tank ventilation system with a line designed to provide pneumatic communication between the tank ventilation system and the at least one cylinder. The line has at least one sensor for determining a hydrocarbon content of a gas flow. A determination, as a function of a measurement signal from the sensor, of a hydrocarbon content of a gas flow flowing from the tank ventilation system to the at least one cylinder is performed. At least one characteristic variable for a fuel quantity to be metered is determined as a function of the determined hydrocarbon content. A metering of fuel into the cylinder is determined as a function of the at least one determined characteristic variable.

11 Claims, 3 Drawing Sheets

METHOD, DEVICE, AND SYSTEM FOR OPERATING AN INTERNAL COMBUSTION ENGINE

BACKGROUND OF THE INVENTION

1. Field of the Invention

The invention relates to a method, device, and system for operating an internal combustion engine having a tank ventilation system.

2. Description of the Related Art

Increasing demands are being made on internal combustion engines with regard to their performance and efficiency. The pollutant emissions must be low due to stringent legal regulations. It is known for internal combustion engines to be fitted with a multiplicity of actuating elements for adjusting a charge in the respective combustion chambers of the cylinders of the internal combustion engine, with the charge being composed, before the combustion, of a mixture of air, fuel, and if appropriate, exhaust gases. Internal combustion engines can be fitted with tank ventilation devices, by means of which fuel emissions, which evaporate from the liquid fuel, from a tank of a vehicle in which the internal combustion engine may be arranged are buffered in an activated carbon reservoir. The activated carbon reservoir is regenerated when its saturation range is reached. The fuel which is bound in the activated carbon filter flows into the intake section of the internal combustion engine and be burned in the respective cylinder of the internal combustion engine. For precise and low-emission operation of the internal combustion engine, it is important for said additionally introduced fuel quantity to be taken into consideration precisely.

SUMMARY OF THE INVENTION

It is an object of the invention to specify a method, a device, and a system for operating an internal combustion engine which permit precise and low-emission operation of the internal combustion engine.

The invention is characterized by a method and a corresponding device for operating an internal combustion engine having at least one cylinder and a tank ventilation system with a line. The line is designed to provide pneumatic communication between the tank ventilation system and the at least one cylinder. The internal combustion engine includes at least one sensor for determining a hydrocarbon content. The hydrocarbon content of a gas flow flowing from the tank ventilation system to the at least one cylinder is determined as a function of a measurement signal from the sensor. At least one characteristic variable for a fuel quantity to be metered is determined as a function of the determined hydrocarbon content. A metering of fuel into the at least one cylinder is controlled as a function of the at least one determined characteristic variable.

As a result of the metering of fuel as a function of the at least one determined characteristic variable for a fuel quantity to be metered being controlled as a function of the determined hydrocarbon content, the controller has a short control path. It is thus possible to ensure that a ratio of fuel to air can be set in the internal combustion engine.

In one embodiment, the method comprises determining at least one further characteristic variable that represents a mass flow through the line. The at least one characteristic variable for a fuel quantity to be metered can be determined as a function of the at least one further determined characteristic variable. At least one yet further characteristic variable which represents a temperature of the gas flow can be determined as a function of a signal from a temperature sensor. The metering of fuel into the at least one cylinder can be controlled as a function of the at least one further determined characteristic variable.

In a further embodiment, at least one further characteristic variable, which represents a speed of sound in the line, is determined as a function of a signal from an ultrasound sensor. The metering of fuel into the at least one cylinder is controlled as a function of the at least one further determined characteristic variable.

The hydrocarbon content can be determined easily and quickly. This is advantageous particularly in the case of a hydrocarbon content that varies in a dynamic fashion.

At least one actuating device for metering fuel is controlled as a function of the at least one characteristic variable. The control of the actuating device for metering fuel enables operation of the internal combustion engine with the lowest possible emissions.

A system for operating an internal combustion engine comprises at least one cylinder, a tank ventilation system with a line which is designed to provide pneumatic communication between the tank ventilation system and the at least one cylinder and at least one sensor for measuring a hydrocarbon content of a gas flow in the line. An evaluation device is set up to evaluate at least one signal from the at least one sensor. At least one actuating device for controlling a metering of fuel into the at least one cylinder is coupled to the evaluation device and can be controlled by the evaluation device as a function of the evaluated signals. By a system of this type, the fuel/air mixture in the internal combustion engine is controlled and the internal combustion engine is preferably operated with the lowest possible emissions.

The at least one sensor comprises, in one embodiment, at least one heating element for heating up a gas flow and at least one temperature sensor. The at least one sensor has at least one further temperature sensor. The at least one heating element can be arranged between the temperature sensor and the further temperature sensor. In this design, it is possible to determine the hydrocarbon content in a relatively precise manner.

The at least one sensor preferably at least one ultrasound source and at least one ultrasound receiver arranged on the line. In one embodiment, the at least one ultrasound source and the at least one ultrasound receiver are embodied as a single component. This is a cost-effective embodiment of the hydrocarbon sensor.

The at least one actuating device preferably comprises an electromagnetic injection valve. The evaluation unit is part of an engine controller for operating the internal combustion engine. Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further features, advantages and refinements emerge from the following examples explained in connection with FIGS. 1 to 4, in which.

DETAILED DESCRIPTION OF THE PRESENTLY PREFERRED EMBODIMENTS

Figure 1:
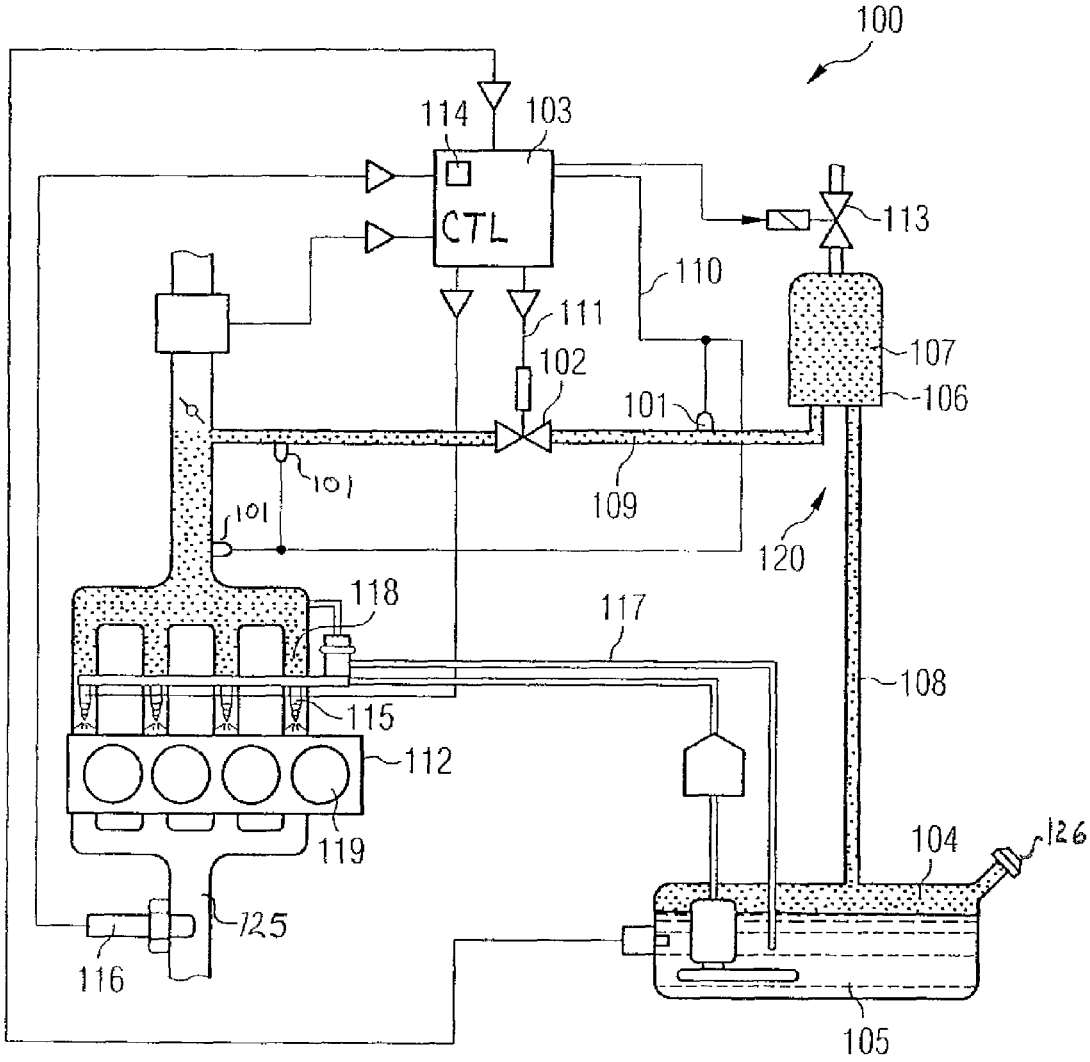
FIG. 1 is a schematic illustration of an internal combustion engine.

FIG. 1 shows an internal combustion engine system 100 which has a fuel tank 104, a combustion engine 112 and a tank ventilation system 120. The tank ventilation system 120 comprises a hydrocarbon tank 106, which is coupled via a line 108 to the fuel tank 104. The hydrocarbon tank is coupled via a line 109 to the combustion engine 112, in particular to an intake section 118 of the combustion engine. The combustion engine 112 comprises at least one cylinder 119 and the line 109 is designed to provide pneumatic communication between the tank ventilation system and the at least one cylinder 119.

Liquid fuel 105, such as gasoline, is stored in the fuel tank 104. Gaseous hydrocarbons 107, which evaporate from the liquid fuel 105, are conducted out of the fuel tank 104 and into the hydrocarbon tank 106 via the line 108 which is coupled between the fuel tank 104 and the hydrocarbon tank 106.

The internal combustion engine system 100 has a plurality of hydrocarbon sensors 101. The hydrocarbon sensors are set up to measure a hydrocarbon content of a gas flow. The hydrocarbon sensors can additionally measure the mass flow of hydrocarbons in the gas flow. It is also possible for only one hydrocarbon sensor to be provided, but further hydrocarbon sensors 101 may also be provided, for example on the hydrocarbon tank 106 or on the intake section 118. The hydrocarbon sensors can also be arranged on further lines, for example on the line 108. A valve 102 is arranged on the line 109 and is configured to control the gas flow to the combustion engine 112. The gas flow through the line 109 is controlled by the valve 102. It is also possible for a plurality of valves, for example two or more valves, to be provided. In one embodiment, valves are provided on other lines, for example on the line 108.

The valve 102 is coupled to an engine controller 103 by an electrical line 111. The sensors 101 are coupled to the engine controller by an electrical line 110. The engine controller 103, which has an evaluation device 114, controls the valves and evaluates signals of the sensors.

The fuel 105 is conducted by means of a fuel feed unit via fuel lines to the combustion engine 112, where the fuel is injected by injection valves 115 into the intake section 118 or into the cylinders 119 and is burned in the combustion engine 112. In one embodiment, the injection valves 115 are electromagnetic injection valves controlled by electrical signals. Other embodiments of injection valves may be provided. The exhaust gases from the combustion process are conducted away from the engine through an exhaust section 125. A lambda probe 116 that determines a ratio of air to fuel is arranged in the exhaust section 125. The lambda probe 116 measures the residual oxygen content in the exhaust gas.

Hydrocarbons, such as methane, butane, or propane, are evaporated from the fuel 105, for example gasoline. The different hydrocarbon chains have different evaporation temperatures, such that different hydrocarbons are evaporated from the liquid fuel 105 depending on an external temperature. The higher the external temperature, and therefore the higher the temperature of the fuel 105, the more hydrocarbons pass into the gaseous phase. The tank 104, which stores the fuel 105, is of gas-tight design, such that the hydrocarbon-containing gas mixture formed in the tank 104 is conducted via the line 108 into the hydrocarbon tank 106.

A tank cover 126 closes off a filler neck of the fuel tank in a correspondingly gas-tight fashion.

The hydrocarbon tank 106 contains an activated carbon storage element. The evaporated hydrocarbons are absorbed and stored by the activated carbon, and are released when required. When the hydrocarbon tank 106 has absorbed a certain quantity of hydrocarbons, it can be emptied via the line 109. For this purpose, air is blown into the hydrocarbon tank from the outside by a valve 113, which air entrains the hydrocarbons. The hydrocarbon-containing air is used as intake air for the combustion engine 112 and thereby contribute to the combustion in the engine 112.

Since a certain quantity of energy is supplied to the combustion engine 112 by the hydrocarbons in the intake air, it is possible for correspondingly less fuel to be injected by means of the injection valves 115. To regulate said ratio, the hydrocarbon content in the supplied air and the mass flow through the line 109 are measured by the hydrocarbon sensors 101.

The evaluation unit 114 evaluates the signals of the sensors 101, such that the concentration of hydrocarbons and the mass flow of the gas flow through the line 109 are known. The quantity of energy supplied to the combustion engine 112 in the form of gaseous hydrocarbons is therefore known. As a function of this, a characteristic variable for the fuel quantity to be metered is determined and the metering of fuel is controlled as a function of the characteristic variable. The engine controller 103 controls the injection valves 115 correspondingly, such that less fuel is injected when more hydrocarbons are supplied via the intake air.

The quantity of gaseous hydrocarbons is controlled by the valve 102. The valve 102 is controlled by the engine controller 103 by pulse-width-modulated signals. The valve 102 may be clock-controllable as a function of at least one signal from the evaluation unit 103. The activated carbon filter can be emptied relatively quickly since the controller 103 operates relatively quickly, in comparison with a controller that relies on data from the lambda probe 116. The quantity of fuel injected into the combustion engine 112 by the injection valves 115 is controlled not only on the basis of the data from the lambda probe 116 but by the data determined by the engine controller 103 by the hydrocarbon sensors 101. The quantity of gas flowing through the line 109 need not be limited, which leads to relatively short regeneration times of the hydrocarbon tank 106. This may be advantageous in particular in vehicles with hybrid drive or a start-stop system in which a reduced engine running time necessitates a fast emptying of the activated carbon filter.

The quantity of fuel injected into the combustion engine 112 by the injection valves 115 is determined by the sensors 101 arranged upstream of the cylinder 119 and by the evaluation device 114. An actuating element or a plurality of actuating elements is controlled based on said data. It is thus also possible for production tolerances and aging effects of the actuating elements, for example of the valve 102 or of the injection valves 115, to be taken into consideration in the controller 103.

The sensors for measuring hydrocarbon content have, a heating element for heating up a gas flow, and a temperature sensor. The sensor is for example integrated on a silicone chip. The gas flow flowing past the sensor element is heated, and the thermal conductivity or heat capacity of the flowing gas can be determined based on the signals from the temperature sensor, which signals are evaluated by the engine controller 103, in particular by the evaluation unit 114. From this, the concentration of hydrocarbons in the gas flow and the mass flow of the gas flow flowing through the line can be determined, since these are proportional to the thermal conductivity or heat capacity of the gas.

Figure 3:
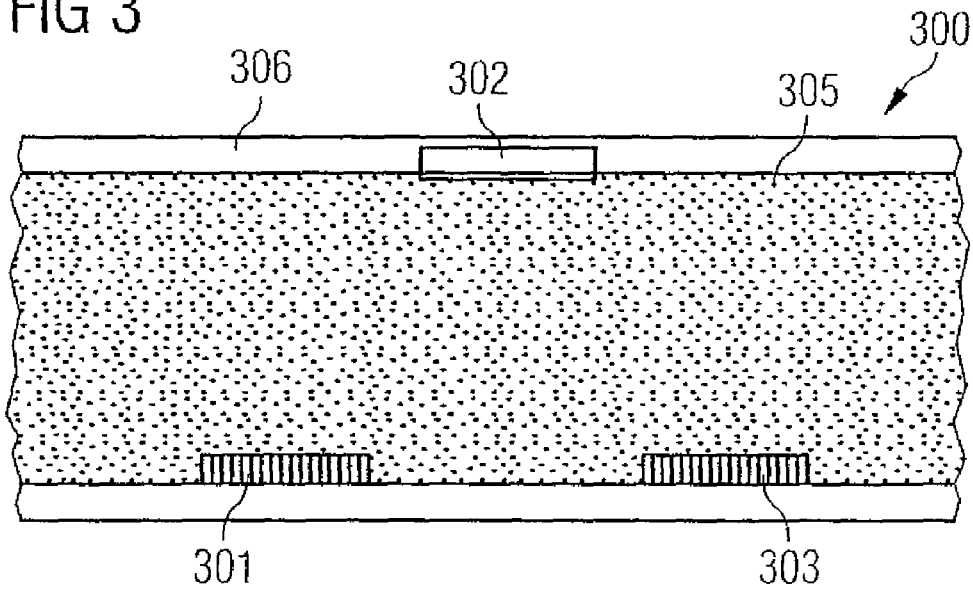
FIG. 3 is a schematic illustration of a sensor according to a further embodiment.

The hydrocarbon sensor may also have at least one ultrasound source and at least one ultrasound receiver. Said sensors are arranged in the line 109 such that ultrasound can be transmitted through the gas flow and travels from the ultrasound source to the ultrasound receiver. Ultrasound can be transmitted once in the opposite direction to the direction of the gas flow and once in the same direction as the direction of the gas flow. From this, it is possible to determine a speed of sound in the gas mixture and the speed of the medium. From this, it is possible to determine the hydrocarbon content and the mass flow of the gas flow. As shown in FIG. 3, the at least one ultrasound source 301 and the at least one ultrasound receiver 303 may also be formed as a single component. An ultrasound transducer of said type is set up to generate ultrasound waves in response to electrical signals. Said ultrasound transducer is also set up to generate electrical signals from received ultrasound waves. The ultrasound transducer can convert electrical signals into acoustic signals and can convert acoustic signals into electrical signals.

Figure 2:
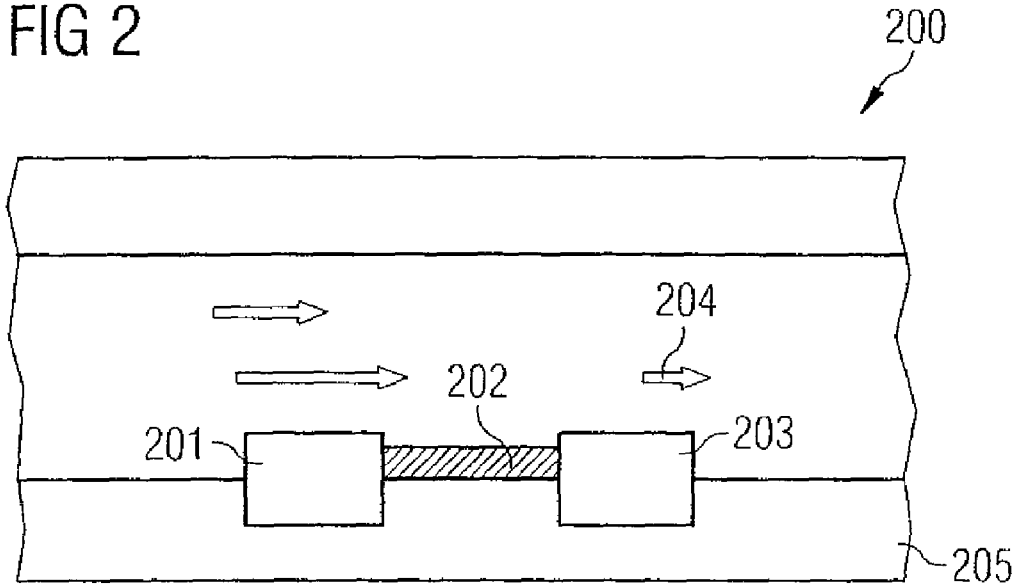
FIG. 2 is a schematic illustration of a sensor according to a first embodiment.

FIG. 2 shows a sensor 200 which is arranged in a line 205. A gas 204 is conducted in the line 205. The sensor 200 has a temperature sensor 201 and a further temperature sensor 203 arranged on one side of a heating element 202. The sensor 200 is set up to measure the concentration of hydrocarbons in the gas 204. The sensor 200 measures the mass flow of hydrocarbons in the gas 204 by the line 205. The sensor 200 can be coupled to an evaluation device which is for example part of an engine controller 103 for operating an internal combustion engine. The line is for example designed to provide pneumatic communication between the tank ventilation system and the at least one cylinder.

The sensor 200 is for example integrated on a silicone substrate and may comprise further components, for example an evaluation circuit, an analog-digital converter or a circuit for temperature compensation. The temperature sensor 201 and the temperature sensor 203 may each have a plurality of temperature sensing elements for measuring a temperature. The gas 204 flowing past the sensor 200 is heated by the heating element 202 in a defined manner. The temperature sensor 201, which is arranged upstream of the heating element, measures the temperature of the gas flow before the gas flow 204 is heated. The further temperature sensor 203 arranged downstream of the heating element 202 measures the temperature of the heated gas. The heat capacity of the gas is determined from a difference between said temperatures. The thermal conductivity of the gas can be determined from the sum of said temperatures. From this, the content of hydrocarbons in the gas 204 and the mass flow through the line 205 can be calculated. By means of the sensor 200, it is possible to very precisely determine the quantity of hydrocarbons flowing through the line 205 at any given time. One or more actuating elements, for example one or more injection valves of an internal combustion engine, can be controlled as a function of said data.

Using the data of the sensor 200, the engine controller or the evaluation device can measure the quantity of energy provided by the gas flow in the most precise manner possible. Said information can in turn be used for controlling injection valves of the internal combustion engine and/or further valves in order to control the ratio of fuel to gas in the most expedient manner possible.

FIG. 3 shows a further embodiment of a hydrocarbon sensor 300. The sensor 300 has an ultrasound source 301 which can likewise serve as an ultrasound receiver. The sensor has an ultrasound source 303 which can likewise serve as an ultrasound receiver. The ultrasound sources 301 and 303 are arranged in a line 306 with a defined spacing to one another. Hydrocarbon-containing gas 305 flows through the line 306. An ultrasound reflector 302 is arranged on the line. The ultrasound sources and receivers 301,303 may also be arranged opposite one another such that no sound reflector 302 is necessary.

The ultrasound source 301 transmits an ultrasound impulse which is transmitted to the further ultrasound receiver 303 via the ultrasound reflector 302. The propagation time can be measured by an evaluation device. After the ultrasound pulse from the first ultrasound source 301 has traveled to the further ultrasound receiver 303 via the ultrasound reflector 302, the further ultrasound receiver is utilized as an ultrasound source. The ultrasound source 303 transmits an ultrasound impulse which travels to the first sound receiver 301 via the ultrasound reflector 302 in a direction counter to the gas flow. The propagation time required for this is measured by the evaluation device 114.

From the measured propagation times between the ultrasound sources and the ultrasound receivers 301,303, it is possible to determine the speed of sound in the gas mixture 305 and the speed with which the gas mixture 305 is flowing through the line 306. For this purpose, a total propagation time and a differential propagation time can be formed. At least one valve can be controlled, and the gas flow through the line 306 thereby controlled, as a function of the determined data. It is also possible for at least one injection valve of a combustion engine to be controlled as a function of said data. A precise ratio of fuel to gas can be set in the combustion chambers by means of the determined data.

Figure 4:
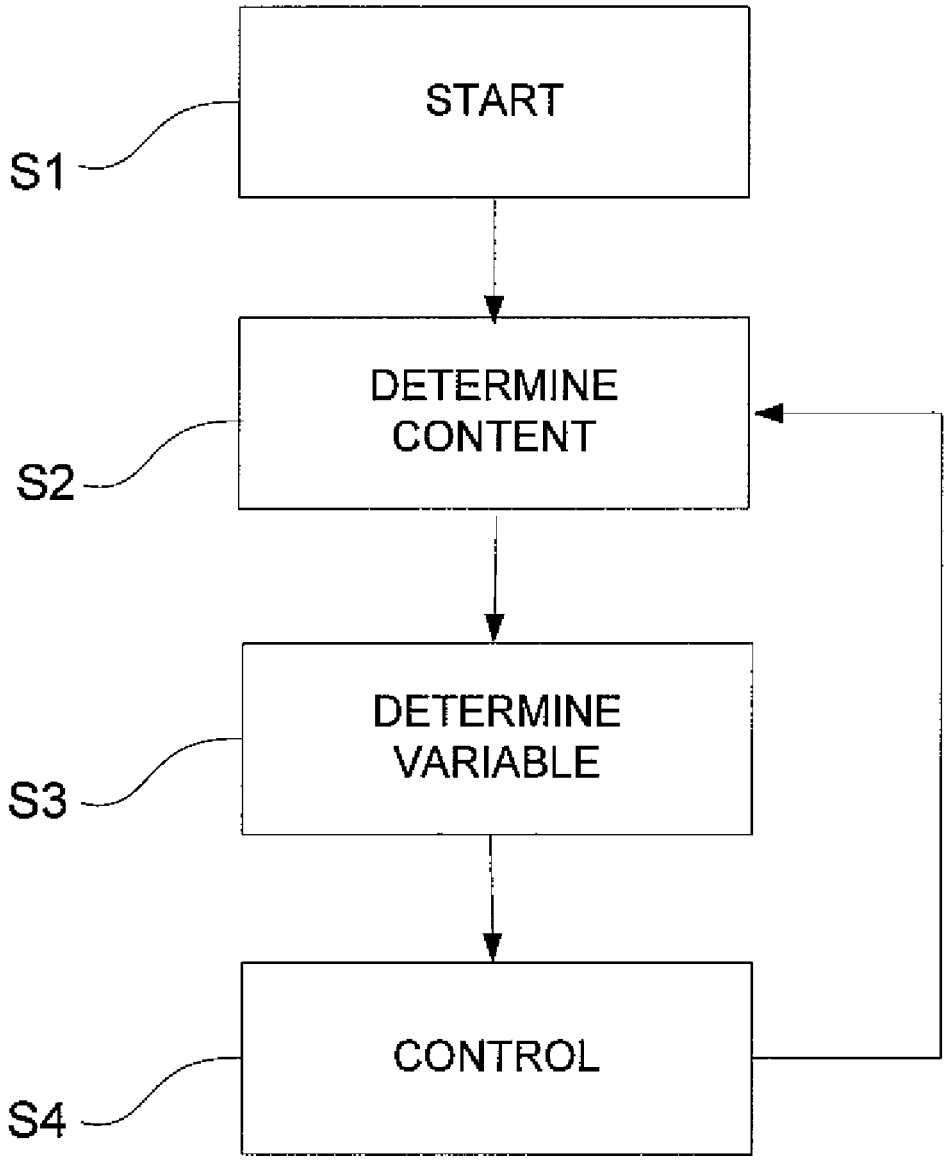
FIG. 4 is a flow chart of a method for operating an engine.

In a first step S1 of a method for operating an internal combustion engine starts, as shown in FIG. 4. The method start may take place shortly after a start of the internal combustion engine 112. In a second step S2, the hydrocarbon content of the gas flow flowing through the line is determined. It is also possible for the hydrocarbon content in the intake section or at further points of the internal combustion engine to be determined. In a third step S3, at least one characteristic variable for a fuel quantity to be metered is determined as a function of the determined hydrocarbon content. A relatively low fuel quantity is metered in the event of a relatively high concentration of hydrocarbons. A relatively high fuel quantity is metered in the event of a relatively low concentration of hydrocarbons. In a step S4, the metering of fuel to the internal combustion engine is controlled as a function of the at least one determined characteristic variable. The control of the metering of fuel is dependent on the determined hydrocarbon content. In one embodiment, step S4 comprises controlling at least one injection valve as a function of the at least one determined characteristic variable, in particular as a function of the determined hydrocarbon concentration.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating an internal combustion engine, the internal combustion engine having at least one cylinder coupled to a tank ventilation system with a line configured to provide pneumatic communication between the tank ventilation system and the at least one cylinder, the line having at least one sensor having at least one heating element and at least one temperature sensor configured for determining a hydrocarbon content, said method comprising:

sensing a temperature of a gas flow from the internal combustion engine by the at least one temperature sensor;

heating the gas flow by the at least one heating element of the at least one temperature sensor;

determining, based at least in part on a measurement signal from the at least one sensor, a hydrocarbon content of a gas flow flowing from the tank ventilation system to the at least one cylinder in the line;

determining, based at least in part on the determined hydrocarbon content, a first characteristic variable for a fuel quantity to be metered;

determining at least one second characteristic variable representing a temperature of the gas flow;

controlling, based at least in part on at least one of the first characteristic variable and the at least one second characteristic variable, a metering of fuel into the at least one cylinder; and controlling, based at least in part on the determined hydrocarbon content, a valve configured to control a metering of gas flow into the at least one cylinder.

2. The method as claimed in claim 1, further comprising:

determining at least one third characteristic variable representing a mass flow through the line; and determining, based at least in part on the at least one third characteristic variable, at least one fourth characteristic variable representing a fuel quantity to be metered.

3. The method as claimed in claim 1, further comprising:

determining, based at least in part on a signal from an ultrasound sensor, at least one fifth characteristic variable representing a speed of sound in the line;

controlling, based at least in part on the at least one fifth characteristic variable, the metering of fuel into the at least one cylinder.

4. The method as claimed in claim 3, further comprising:

controlling, based at least in part on the at least one first characteristic variable, at least one actuating device for metering fuel.

5. A device for operating an internal combustion engine, the internal combustion engine having at least one cylinder, the at least one cylinder coupled to a tank ventilation system via a line configured to provide pneumatic communication between the tank ventilation system and the at least one cylinder, the line having at least one sensor configured to determine a hydrocarbon content of a gas flow, the at least one sensor having at least one heating element configured to heat the gas flow and at least one temperature sensor, the device configured to:

determine, based at least in part on a measurement signal from the at least one sensor, a hydrocarbon content of a gas flow flowing from the tank ventilation system to the at least one cylinder in the line;

determine, based at least in part on the determined hydrocarbon content, a first characteristic variable for a fuel quantity to be metered;

determine, based at least in part on a signal from a temperature sensor, at least one second characteristic variable representing a temperature of the gas flow;

control, based at least in part on at least one of the first characteristic variable and the at least one second characteristic variable, a metering of fuel into the at least one cylinder; and control a valve, based at least in part on the determined hydrocarbon content to control a metering of a gas flow into the at least one cylinder.

6. An internal combustion engine system, comprising:

an internal combustion engine having at least one cylinder;

a tank ventilation system;

a line configured to provide pneumatic communication between the tank ventilation system and the at least one cylinder;

at least one sensor configured for measuring a hydrocarbon content of a gas flow in the line comprising:

at least one heating element configured to heat the gas flow; and at least one temperature sensor;

an evaluation device configured for evaluating at least one signal from the at least one sensor, the evaluation device configured as a part of an engine controller for operating the internal combustion engine;

at least one actuating device configured for controlling a metering of fuel into the at least one cylinder, the at least one actuating device coupled to the evaluation device and configured to be controlled by the evaluation device based at least in part on the evaluated signals;

a valve configured for controlling the throughflow of the gas flow through the line, the valve coupled to the evaluation device and configured to be controlled by the evaluation device based at least in part on the evaluated signals in a clock-controllable fashion.

7. The system as claimed in claim 6, wherein the at least one sensor further comprises:

at least one further temperature sensor, wherein the at least one heating element is arranged between the at least one temperature sensor and the further temperature sensor.

8. The system as claimed in claim 7, in which the at least one sensor has at least one ultrasound source and at least one ultrasound receiver arranged on the line.

9. The system as claimed in claim 8, wherein the at least one ultrasound source and the at least one ultrasound receiver are embodied as a single component.

10. The system as claimed in claim 6, wherein the at least one actuating device is an electromagnetic injection valve.

11. The method as claimed in claim 1, wherein the valve is controlled by a pulse-width-modulated signal.

* * * * *